US006022591A

United States Patent [19]

Ueberschär

[11] Patent Number: 6,022,591

[45] Date of Patent: Feb. 8, 2000

[54] METHOD AND APPARATUS FOR THE APPLICATION OF A COATING OF A LIQUID OR PASTY MEDIUM ONTO A MOVING LAYER OF MATERIAL, ESPECIALLY PAPER OR CARDBOARD

[75] Inventor: Manfred Ueberschär, Nattheim, Germany

[73] Assignee: Voith Sulzer Papiermaschinen GmbH, Heidenheim, Germany

[21] Appl. No.: 08/889,702

[22] Filed: Jul. 8, 1997

[30] Foreign Application Priority Data

Jul. 8, 1996 [DE] Germany ..... 196 27 470
Jul. 8, 1996 [DE] Germany ..... 196 27 489

[51] Int. Cl.[7] ..... B05D 3/12

[52] U.S. Cl. ..... 427/356; 118/325; 118/413; 427/414

[58] Field of Search ..... 118/410, 411, 118/413, 414, 122, 118, 119, 325; 427/356, 424, 421

[56] References Cited

U.S. PATENT DOCUMENTS 4,245,582 1/1981 Alheid et al. ..... 118/119
4,869,933 9/1989 Sollinger et al. ..... 118/126
4,899,687 2/1990 Sonnmer et al. ..... 118/126
5,134,958 8/1992 Zimmer ..... 118/119
5,785,253 7/1998 Ueberschär et al. .

*Primary Examiner*—Brenda A. Lamb
*Attorney, Agent, or Firm*—Taylor & Associates, P.C.

[57] ABSTRACT

An applicator implement applies liquid or pasty coating medium directly onto a moving layer of material, in particular paper or cardboard. The applicator implement includes a pre-metering device which extends along the width of the moving material layer. The pre-metering device is divided into a number of segments, each of which are in turn associated with at least one actuator that enables the segments to move with respect to the thickness of the material layer in order to shape a desired profile of the pre-metering device. The applicator implement further includes, following along the path of movement of the material layer, a finishing metering device which also extends along the width of the moving material layer, and which is divided into a number of segments, each of which are in turn associated with at least one actuator that enables the segments to move with respect to the thickness of the material layer in order to shape a desired profile of the finishing metering device. The widths of the segments of the pre-metering device and the finishing metering device are identical according to a first embodiment or first base model. According to a second embodiment or second base model, the widths of the segments of the pre-metering device and the finishing metering device are not identical.

19 Claims, 7 Drawing Sheets

METHOD AND APPARATUS FOR THE APPLICATION OF A COATING OF A LIQUID OR PASTY MEDIUM ONTO A MOVING LAYER OF MATERIAL, ESPECIALLY PAPER OR CARDBOARD

BACKGROUND OF THE INVENTION

1. Field of the invention

The present invention relates to an apparatus to facilitate the coating of a running layer of material, in particular paper and/or cardboard. The invention also relates to a method of establishing the desired cross-sectional profile of the liquid or pasty coating medium across the width of a moving layer of material.

2. Description of the related art

It is known to integrate devices into so-called coating machines (and applicator implements) for applying one or several layers of liquid or pasty coating media onto one or both sides of a moving layer of material, such as paper, cardboard, or textile fabrics. Typically, coating media include, for example, coatings containing pigments, starches, or liquids used to impregnate a material and so forth.

According to the direct application method, an applicator device applies the coating medium directly onto the moving layer of material along a segment where the material layer is supported by a moving surface, such as for example, a counter roller or a continuous conveyor belt. For this sort of approach, the applicator implement also often functions as a pre-regulator (also pre-metering) device that dispenses predetermined amounts of the liquid or pasty coating medium, which in these cases are intentionally in excess of what is required. After the moving layer of material has passed the pre-regulating/dispenser device, it passes a second regulator device, also known as a fine-metering device, fine-dosing device, or leveling device. The second regulator device readjusts the previously dispensed amounts of liquid or pasty coating medium, and can include a spreader element, a coating blade, a spreader roller, or a rolling wiper stick. The second regulator device generally extends across the entire width of the moving layer of material, and is pressed onto the surface of the material layer. Further, the second regulator device wipes the excess amounts of liquid or pasty coating medium off of the moving material layer, and thus leaves the desired quantity of coating medium on the surface of the moving material layer. The second regulating or fine-metering device is usually subdivided into a large number of segments which extend along the width of the moving material layer. Each segment is associated with an actuator which can be independently controlled. Thus, the profile shape and the pressure of the blade or wiper along each segment onto the material layer can be defined separately, so that ultimately the desired cross-sectional profile of coating medium can be achieved. The actuators are usually remotely controlled by an automatic control system which gathers measurements of the thickness of the applied coating of liquid or pasty medium. The actuators can also be adjusted by hand.

More recent applicator implements already contain pre-regulating dispenser devices with adjustable cross-sectional profiles that can control the thickness profile of the applied coating. For this purpose, one uses a pre-regulating dispenser device with a free streaming jet applicator implement whose exit nozzle is formed by two lips, i.e., one lip upstream and one lip downstream relative to the passage of the moving material layer. The two lips are also sub-divided into segments along the width of the moving layer of material, where an actuator is associated with each of the segments in the up-stream and the down-stream lip. With the actuators, either lip can be either adjusted as a whole or the distances between the consecutive segments of each lip can be adjusted individually. It is also possible to adjust both lips simultaneously. The before-mentioned actuators are either remotely controlled or can be adjusted manually, whereby the automatic control of the individual actuators is set up as a closed loop system which adjusts the actuators based on input received concerning the thickness profile of the applied coating of liquid or pasty medium. Such an applicator implement has been mentioned in the German Document No. 4432177 and is known under the trademark "Jet Flow F".

The combination of pre-regulating and finishing regulating devices can be distinguished in two different categories, i.e., one where the pre-regulating and the finishing regulating are spatially separated in two different compartments and another where the two operations take place right next to one another, without spatial separation. The spatially separated version is such that the first metering device is associated with a first counter roller while further down along the path of the moving layer of material a second metering device is associated with another counter roller. Such a configuration of an applicator implement is already known from the German Document No. 3715307. A connected version of pre-metering and finishing metering devices, on the other hand, is such that both devices are associated with the same counter roller.

Another applicator implement for a similar procedure to regulate the profile of the coating thickness of a liquid or pasty medium across the width of a moving layer of material, in particular paper or cardboard, can be found in an appended note with the official symbol 196 05 183.5 which is characterized by the use of actuators to control the coating thickness at a pre-regulating device as well as a finishing regulating device. The combination of both adjustments results in the desired overall correction of the profile of the coating thickness.

This solution produces a coating thickness that requires only very little readjusting to the cross-sectional profile across the material layer width in the second metering step. Thus, the finishing regulating device, especially if it is a spreader blade, will be spared from premature uneven wear and will have a much longer service life.

Since this method relies on very minute synchronized movements of a number of actuators in order to obtain the desired adjustments to the coating thickness, the construction of the device requires a considerable amount of precision and regard to detail.

SUMMARY OF THE INVENTION

The present invention provides a coating machine, having a simple and effective construction, which is capable of producing a final product of very high quality, and which is capable of two steps of control of the profile of the coating thickness by precisely synchronized movements of the pre-metering device and the finishing metering device. The present invention also provides a method suitable for adjusting the thickness profile of a coating of a liquid or pasty medium which has been applied onto a moving layer of material, particularly paper or cardboard, by the apparatus of this invention.

The relative sizes of the movable segments of the pre-metering device and the finishing metering device have a special impact on the final quality of the final profile of the thickness of the coating of a liquid or pasty medium. The final profile is controlled by the profile adjustments of the pre-metering device and the finishing metering device. In one embodiment of the present invention, the respective lengths of segments of the pre-metering device and the finishing metering device, as they extend transverse to the movement of the material layer, are substantially identical. In contrast to this, in another embodiment of the present invention, the respective lengths of segments of the pre-metering device and the finishing metering device are different from one another. In the context of this invention, "segments" are sections of the pre-metering device or the finishing metering device which extend transversely to both the path of movement of the layer of material and to the thickness of the layer. The segments are each associated with one or more strategically placed actuators each so that they can be moved independently from one another along the direction of the thickness of the moving layer of material in order to locally define the thickness of the layer of applied coating until the desired thickness profile is obtained. As long as there is only one actuator associated with any particular segment, the thickness profile within this segment of the pre-metering device or the finishing metering device can only be uniform, but if more actuators are assigned to one segment then it is possible to obtain a variable thickness profile of the applied coating within the extent of this segment.

If a free streaming jet applicator implement is employed with an opening slot which is formed between two lips, one next to the other along the direction of the path of the moving layer of material, then the lip on the incoming side of the material layer as well as the lip on the outgoing side of the material layer can be subdivided into segments which are completely physically separated from one another. The same physical separation can be applied to the wiping board of a finishing metering device which is structured like a comb. If all of the actuators of the finishing metering device act directly on movable segments of an adjustable spreader element, it is advisable to not physically separate the individual segments from one another. In this way, the formation of grooves or ridges in the applied coating is avoided. The regional adjustments along the width of the moving layer of material is facilitated by the elastic deformation of the segments of the spreader element. This last version is of course also possible for the pre-metering device.

The application implement according to this invention allows, with relatively simple but effective means, a high degree of locally variable adjustments to the cross-sectional profile of the metering devices. The adjustments are made possible by the specific relative lengths of the individual segments, providing a wide window for profile adjustments that are easily but very precisely definable. A high degree of control over the profile of thickness of the coating of liquid or pasty medium is provided, resulting in a coated layer of material of very high quality. This invention furthermore minimizes the profile adjustments that need to be made by the finishing metering device, so that wiper blades or similar instruments that could be employed would not be subject to localized or uneven wear, thus prolonging the service lifetime of these tools. In addition, the excess amounts of the liquid or pasty coating medium can be significantly reduced.

In another embodiment of the present invention, the segments of the pre-metering device are kept in line with the corresponding segments of the finishing metering device, so that the beginnings and ends of the corresponding segments are just displaced along the direction of the path of the moving layer of material. This enhances the quality of the thickness profile of the applied coating of liquid or pasty medium.

In another variation of an applicator implement, segments of the finishing metering device are staggered by a certain distance from the segments of the pre-metering device, so that the beginnings and ends of the segments are not just displaced along the direction of the path of the moving layer of material. The use of this variation of an applicator implement depends on certain process parameters, as for example the type of coating medium, the sort of material layer, the amount of wear on the spreader element, and so on. Further, this variation of an applicator implement can reduce possible deviations from the desired thickness profile of the applied coating.

The segments of the finishing metering device are offset against the segments of the pre-metering device along the direction of the path of the moving layer of material by a precise, predetermined displacement. In the first embodiment of this invention, wherein the segments of the finishing metering device are identical to the segments of the pre-metering device, the displacement corresponds to one half of the width of the identical segments of the finishing metering device and the pre-metering device. In the second embodiment of this invention, wherein the segments of the finishing metering device are different from the segments of the pre-metering device, the displacement corresponds to one half of the length of the smaller of the finishing metering device segment and the pre-metering device segment.

Another embodiment of the apparatus of this invention utilizes at least two different widths of segments for the pre-metering device and/or finishing metering device.

In yet another embodiment of the apparatus of this invention, the distances between the points of displacement of each of the actuators on any segment of the pre-metering device and the beginning and end points of the segment are the same as the distances between the points of displacement of the corresponding actuators on the corresponding segment of the finishing metering device and the beginning and end points of the corresponding segment. If only one actuator is associated with a particular segment of the pre-metering device, then the division of the segment by the actuator is identical to the before-mentioned division of the corresponding segment of the finishing metering device. If there is more than one actuator associated with one or more corresponding segments of the finishing metering device and the pre-metering device, respectively, then the identical division of the segments may differ from the identical widths of the segments of the finishing metering device and the pre-metering device, respectively. According to this invention the point of displacement of an actuator has to be understood as an infinitesimally small region on the pre-metering device and the finishing metering device, respectively, on which the actuator is acting.

It is on one hand preferable that the points of displacement of corresponding actuators on the pre-metering device and the finishing metering device, respectively, will only be displaced along the direction of travel of the moving layer of material.

It is on the other hand preferable for certain applications of this invention that the points of displacement of corresponding actuators on the pre-metering device and the finishing metering device, respectively, will be displaced along the direction of travel of the moving layer of material as well along the width of the moving layer of material. The actuators can be displaced from one another along the width of the moving layer of material by a distance that corresponds to one half of the division of the given corresponding identical segments.

Another embodiment of the apparatus of this invention prescribes that the segments of the pre-metering device and the segments of the finishing metering device are of identical widths, but that in contrast to the previously described embodiment, the relative locations of the points of displacement of corresponding actuators with respect to the segments on the pre-metering device are different from the relative locations of the actuators with respect to the corresponding segments of the finishing metering device. Thus, the way that the actuator location sub-divides the segments to which they are attached can differ from the segments of the pre-metering device to the segments of the finishing metering device. This sort of parametric variation constitutes yet another way of controlling the profile of the thickness of the coating of liquid or pasty medium.

As the points of displacement of the actuators divide the segments on the pre-metering device and the finishing metering device into sub-divisions, so to speak, the number of sub-divisions along the pre-metering device can be a multiple of the number of sub-divisions on the finishing metering device, or vice versa.

In yet another embodiment of the apparatus according to this invention, the sum of the before-mentioned smaller sub-divisions along the entire width of one of the metering devices equals the sum of the greater of the before-mentioned sub-divisions along the entire width of the corresponding other metering device.

In another embodiment of this invention, there are at least two different sizes of sub-divisions as they are sub-divided by the points of displacement of the associated actuators of the segments of the pre-metering device. In an embodiment where the segments of the pre-metering device are equal to the segments of the finishing metering device the location of the points of displacement of the associated actuators can be distributed evenly or in an irregular pattern, whereby the distance between at least two neighboring actuator locations would not be the same as the others.

In yet another embodiment of this invention, there are at least two different sizes of sub-divisions of the segments of the finishing metering device as they are, so to speak, sub-divided by the points of displacement of the associated actuators with which they are associated.

In order to have better control over the cross-sectional thickness profile along the outer fringes of the moving layer of material, another feature of the apparatus of this invention is fringe segments which are added to the pre-metering device and/or finishing metering device just to extend past the width of the moving layer of material. Such fringe segments can also be regular segments that just happen to extend past the width of the moving layer of material, thus contributing much desired control over the fringe region.

Another additional feature of the apparatus of this invention holds that the fringe segments of the pre-metering device and/or finishing metering device are special segments insofar as their extent could differ from that of the regular segments of the pre-metering device and/or finishing metering device.

In this context it is pointed out that the width of the fringe segments of the pre-metering device could be the same as the width of fringe segments of the finishing metering device or they could be different from one another. It is most common that the width of the fringe segments of the finishing metering device would be more than the width of the fringe segments of the pre-metering device because they have to accommodate an increase in width of the moving material layer due to a sort of dilation that results from the application of the liquid or pasty coating medium. This effect that can be observed as the material layer passes the finishing metering device.

In order to maximize the control over the cross-sectional thickness profile of the applied coating along the outer fringes of the moving layer of material it is important that the point of displacement of the actuator of at least one fringe segment of the pre-metering device is in line with the point of displacement of the actuator of at least one fringe segment of the finishing metering device as seen along the path of movement of the layer of material. For this particular assignment of the points of displacement of the actuators, one has to consider the previously mentioned dilation of the moving layer of material, so that small deviations from the assigned positions for the points of displacement of the actuators may have to be taken into account.

Another embodiment of the apparatus of this invention includes an automatic control system wherein the pre-metering device and the finishing metering device are both incorporated in a well tuned control loop of the control system. This allows quick and reliable adjustments of the coating machine to accommodate changes of process conditions.

A purpose of this invention is to control the cross-sectional thickness profile of a coating applied as a liquid or pasty medium directly onto a moving layer of material, in particular paper or cardboard. In still another embodiment, the cross-sectional thickness profile of a coating applied as a liquid or pasty medium directly onto a moving layer of material is controlled by adjustments of the actuators associated with segments of the pre-metering device as well as by adjustments of the actuators associated with segments of the finishing metering device, such that the corrections to the thickness profile arising out of adjustments made by the pre-metering device complement the corrections to the thickness profile arising out of adjustments made by the finishing metering device to a complete correction of the cross-sectional thickness profile of the coating. The process described by this invention provides the same advantages that have already been described in connection with the application implement.

To optimize the control over the cross-sectional thickness profile of the coating, long-wave and short-wave corrections to the coating thickness are utilized by coordinated adjustments of the actuators associated with the pre-metering device and finishing metering device, respectively, to correct deviations from the nominal coating thickness. Analogous to this method, another method utilizes short-wave corrections with the pre-metering device and long-wave corrections with the finishing metering device to correct deviations from the nominal coating thickness.

By starting with predetermined operations of the pre-metering device, this sort of control can allow the use of either long-wave or short-wave adjustments to the cross-sectional thickness profile of the coating, and with that the coating weight of the applied coating of liquid or pasty medium or an adjustment to another parameter that may be related to either the cross-sectional thickness profile or the coating weight. These parameters include, for example, the shine, the opacity, the degree of whiteness, the moisture and many others. This provides more effective control and fewer adjustments are needed from the actuators. Hence, all the components that move during these adjustments will have a longer service life.

The adjustments of the actuators of the pre-metering device and the finishing metering device can be provided in sequence or more or less synchronously.

In general, the pre-metering device as well as the finishing metering device can also be adjusted manually. If a control system is provided, it is also possible to adjust one metering device by hand and the other through the control system. Alternatively, both metering devices can be adjusted by two independent control systems, or both metering devices can be adjusted by control systems that are tuned with one another.

Rough adjustments to the cross-sectional thickness profile of the applied coating can be made with the pre-metering device and subsequently the fine adjustments can be made with the finishing metering device. But it is also possible that the rough adjustments can be made with the finishing metering device and the fine adjustments with the pre-metering device. The order of rough adjustments and fine tuning are interchangeable depending on circumstances.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
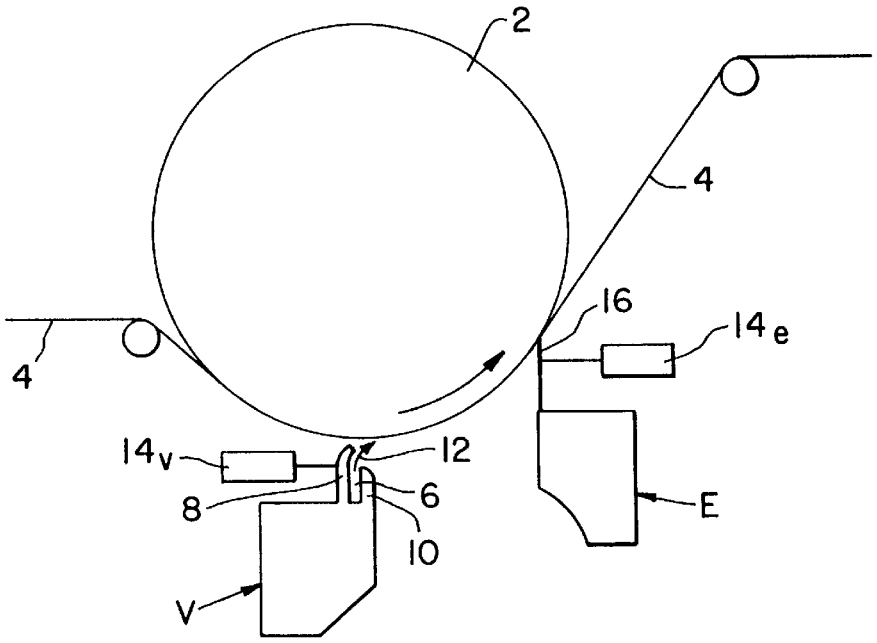
FIG. 1 is a schematic cross-sectional view of the first base model of the coating machine of the present invention.

Referring now to the drawings and particularly to FIG. 1, there is shown a schematic cross-sectional view of the first base model of the coating machine of the present invention. The coating apparatus incorporates counter roller 2 which supports moving layer of material 4 as it passes by while being coated. The direction of rotation of counter roller 2 and the corresponding direction of movement of layer of material 4 are indicated by an arrow. Pre-metering device V faces counter roller 2 and functions as an applicator implement. Pre-metering device V incorporates a large beam (not shown) that extends over almost the entire length of pre-metering device V and which contains a distributor pipe which conducts the liquid or pasty medium, or coating medium, that is to be applied onto moving layer of material 4. On its way to impinging onto moving layer of material 4, the pressurized coating medium moves to the end of the pipe, where it exits through a free streaming jet applicator implement. The free streaming jet applicator is a metering slot 6 in the shape of two lips, one lip 8 being on the incoming side of moving material layer 4 and the other lip 10 being on the outgoing side of moving material layer 4. The coating medium is indicated by arrow 12.

In order to adjust the thickness profile of the applied coating medium along the width of moving layer of material 4 as well as along its direction of movement, pre-metering device V is divided along the width of layer of moving material 4 into a large number of movable segments, each of which is associated with at least one actuator $\mathbf{14}_V$. This allows lip 8 to be adjusted evenly over the width of material layer 4 or shaped into a profile by moving either all or only a selected group of actuators $\mathbf{14}_V$ and thus the associated segments. The exact details of the configuration of the segments of pre-metering device V are described in following paragraphs.

As illustrated in FIG. 1, the movement of material layer 4 follows from pre-metering device V to finishing metering device E. Finishing metering device E incorporates a support beam (not shown) and a fixture which, in turn, holds a spreader element. The spreader element in essence is spreader blade 16 which extends over almost the entire width of moving layer of material 4, and which levels the coating medium previously applied onto moving material layer 4 by pre-metering device V down to a desired thickness profile. Finishing metering device E, which in this case is spreader blade 16, is composed of a number of movable segments that extend across the width of moving layer of material 4, whereby each segment is associated with at least one actuator $\mathbf{14}_e$. The segments of spreader blade 16 are of a predefined extent along the width of moving material layer 4. Each segment is associated with at least one actuator $\mathbf{14}_e$ so that it can be moved with respect to the other equally equipped segments of spreader blade 16. This allows the development of locally variable thickness profiles of the coating as seen along the width of moving layer of material 4. The ability to control the thickness profile of the coating is based on the fact that deformations to the profile of spreader blade 16 are fully reversible. Profile adjustments to spreader blade 16 are not made possible at the cost of separation, leading to gaps and such between neighboring segments. This sort of full or partial separation between neighboring gaps is plausible for certain other applications, such as in the case of a spreader element fixture having a comb-like array of segments, so-called spreader elements, acted upon by actuators $\mathbf{14}_e$. The exact details of the configuration of the segments of finishing metering device E are described in following paragraphs.

Actuators $\mathbf{14}_e$ or $\mathbf{14}_V$ of finishing metering device E and pre-metering device V are connected into the loop of at least one control unit (not shown). Thus, in an actual industrial process a quick and dependable adjustment is possible in response to one of many factors which can influence the outcome of the thickness profile of the applied coating.

Figure 2:
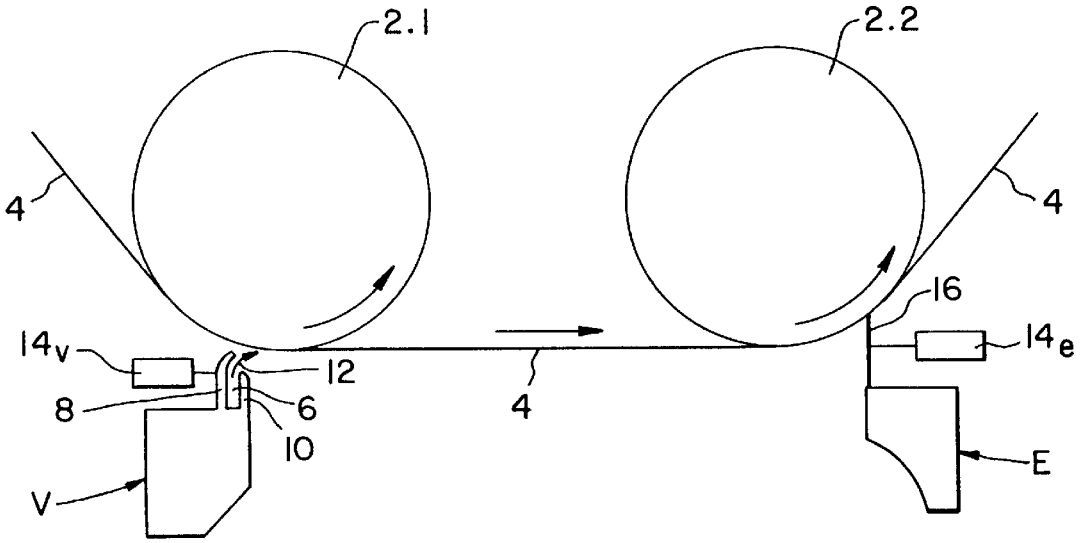
FIG. 2 is a schematic cross-sectional view of the second base model of the coating machine according to the invention.

FIG. 2 shows a schematic cross-sectional view of the second base model of the coating machine of this invention. This base model of this configuration is much like the one shown in FIG. 1, except that this applicator implement provides for a pre-metering process that is spatially separated from the finishing metering process. Hence, pre-metering device V is associated with a first counter roller 2.1 and finishing metering device E, which is next following the movement of material layer 4, is associated with a second counter roller 2.2.

The two configurations illustrated by the base models shown in FIGS. 1 and 2 apply to all the varying embodiments shown in FIGS. 3 through 20.

Figure 3:
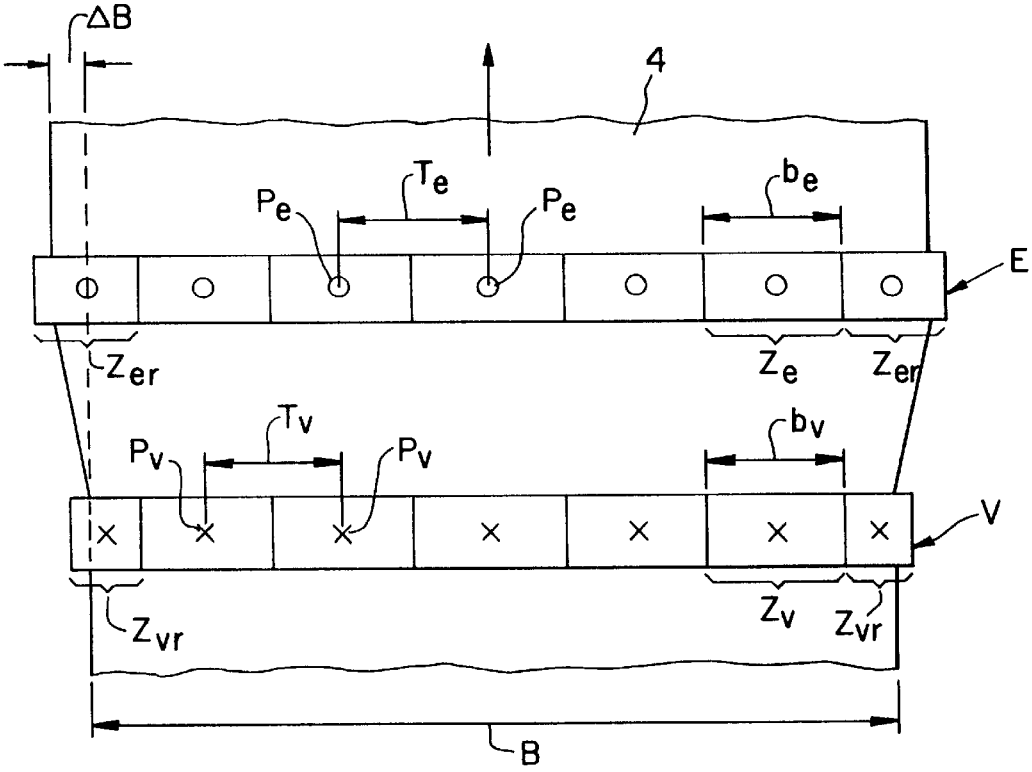
FIGS. 3–13 are each a schematic top view of separate embodiments of the segments of the pre-metering device and the finishing metering device of the first base model of FIG. 1, each of which is for illustration purposes shown on the same sketching plane.

FIG. 3 is a schematic top view of a first embodiment of the first base model of the applicator implement of this invention wherein segments $Z_V$ of pre-metering device V and segments $Z_E$ of finishing metering device E are shown on the same sketching plane for illustration purposes. The respective segments $Z_V$ and $Z_e$ of pre-metering device V and finishing metering device E are represented in a very simplified version as small rectangular boxes. Segments $Z_V$ and $Z_e$ extend across almost the entire width B of moving layer of material 4 whereby widths $b_V$ of segments $Z_V$ of pre-metering device V are equal to the widths $b_e$ of segments $Z_e$ of finishing metering device E. Segments $Z_V$ of pre-metering device V are directly in line with segments $Z_E$ of finishing metering device E as seen along the direction of movement of layer of material 4, meaning that there is no transverse displacement along the width of moving material layer 4. The number of segments $Z_V$ and $Z_e$ and their respective widths $b_V$ and $b_e$ may vary according to the requirements of a particular application, so that FIG. 3 itself only illustrates the concept of this embodiment. Both pre-metering device V and finishing metering device E exceed the width of moving layer of material 4, indicated by $Z_{VR}$ and $Z_{er}$ as fringe regions. Widths $b_{VR}$ of fringe regions $Z_{VR}$ of pre-metering device V are different from widths $b_V$ of the other segments $Z_V$ of pre-metering device V. In the same manner, widths $b_{eR}$ of fringe regions $Z_{eR}$ of finishing metering device E are different from widths $b_e$ of the other segments $Z_e$ of finishing metering device E. In order to accommodate an extension ΔB of moving layer of material 4 along its width due to a sort of dilation which occurs as a result of the application of the coating of liquid or pasty medium and the passage through pre-metering device V, width $b_{eR}$ of fringe region $Z_{eR}$ of finishing metering device E is larger than widths $b_{VR}$ of fringe region $Z_{VR}$ of pre-metering device V.

Fringe regions $Z_{VR}$ and $Z_{er}$ could also be as wide as all the other segments $Z_V$ and $Z_e$ of pre-metering device V or finishing metering device E, respectively. Such could be the case if a regular segment $Z_V$ or $Z_e$ would extend with its regular width over the edge of a pre-metering or finishing metering device.

Points of displacement $P_V$ where actuators $\mathbf{14}_V$ attach to pre-metering device V are generally represented as crosses while points of displacement $P_e$ where actuators $\mathbf{14}_e$ attach to finishing metering device E are represented as little circles. In the context of this invention, the term, "point of displacement of an actuator," should be understood as an infinitesimally small region where the actuator attaches to the pre-metering device or the finishing metering device.

In the embodiment of this invention shown in FIG. 3, sub-divisions $T_V$ which are defined by the distance between points of displacement $P_V$ of adjacent actuators $\mathbf{14}_v$ are of identical length as sub-divisions $T_e$ which are defined by the distance between points of displacement $P_e$ of adjacent actuators $\mathbf{14}_e$. Sub-divisions $T_v$ and $T_e$ are in line with one another as seen along the direction of movement of material layer 4. Also, the points of displacement of fringe segments $Z_{vr}$ of pre-metering device V are in line as seen along the direction of movement of material layer 4 with points of displacement of fringe segments $Z_{er}$ of finishing metering device E. The locations of the points of displacement of fringe segments $Z_{vr}$ and $Z_{er}$ of pre-metering device V and finishing metering device E relative to the width of moving layer of material 4 can vary somewhat to accommodate an extension ΔB of moving layer of material 4 along its width, a sort of dilation which occurs as a result of the application of the coating of liquid or pasty medium and the passage through pre-metering device V.

In FIGS. 4 through 12, which show views corresponding to FIG. 3, moving layer of material 4 has been omitted in order to avoid convoluting the drawings.

Figure 4:
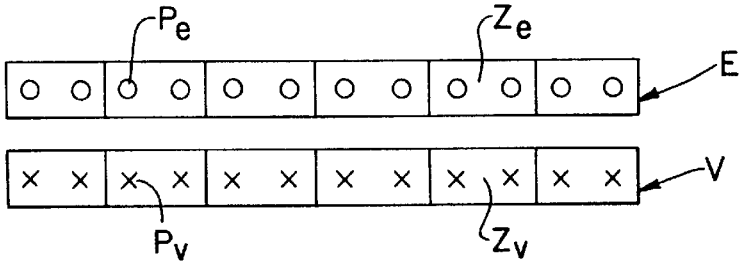

FIG. 4 shows a variation of the embodiment shown in FIG. 3 corresponding to the second embodiment of the apparatus of this invention wherein segments $Z_{vr}$ and $Z_{er}$ of pre-metering device V and finishing metering device E are directly in line with one another as seen along the direction of movement of material layer 4 without any displacement to one another along the width of moving layer of material 4. The distinctive feature of this embodiment is that there are two actuators associated with every segment $Z_v$ of pre-metering device V and every segment $Z_e$ of finishing metering device E. Accordingly, there are two points of displacement $P_v$ of adjacent actuators associated with segments $Z_v$ of the pre-metering device V as well as two points of displacement $P_e$ of adjacent actuators associated with segments $Z_e$ of finishing metering device E which are located in line with one another as seen along the direction of movement of material layer 4.

Figure 5:
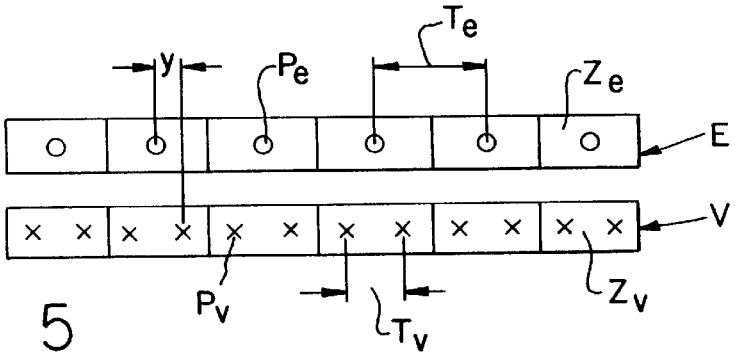

FIG. 5 shows a third variation of the embodiment of the apparatus according to this invention wherein segments $Z_v$ of pre-metering device V are identical and in line with segments $Z_e$ of finishing metering device E, but the sub-divisions $T_V$ which are defined by the distance between points of displacement $P_V$ of adjacent actuators $\mathbf{14}_v$ are not of identical length as sub-divisions $T_e$ which are defined by the distance between points of displacement $P_e$ of adjacent actuators $\mathbf{14}_e$. This is a consequence of there being two points of displacement $P_V$ of actuators that are associated with every segment $Z_v$ of pre-metering device V while there is only one point of displacement $P_e$ of an actuator that is associated with every segment $Z_e$ of finishing metering device E, so that the length of sub-division $T_e$ is an integer multiple of the length of sub-division $T_v$. In the embodiment shown in FIG. 5, $T_e=2*T_v$. Looking at the pre-metering device and the finishing metering device along the direction of movement of layer of material 4, it becomes apparent that points of displacement $P_V$ of actuators that are associated with segment $Z_v$ of pre-metering device V are not in line with points of displacement $P_e$ of actuators that are associated with segments $Z_e$ of finishing metering device E. It follows out of this configuration that the locations of points of displacement of segments $Z_v$ of pre-metering device V are displaced by a certain amount Y with respect to locations of points of displacement of segments $Z_e$ of finishing metering device E along the width of moving layer of material 4.

Figure 6:
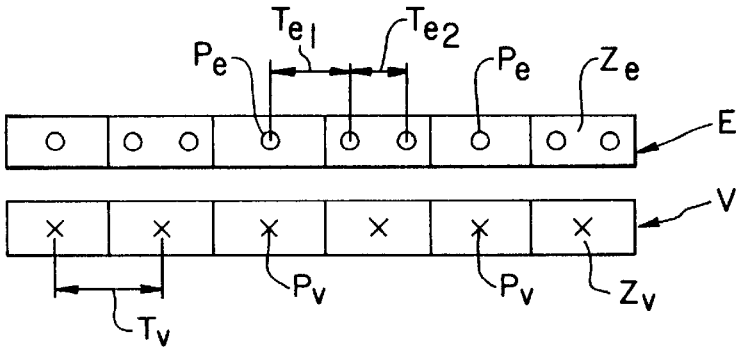

FIG. 6 shows a fourth embodiment wherein segment $Z_v$ of pre-metering device V and segment $Z_e$ of finishing metering device E are located along a line as seen along the direction of movement of material layer 4, but wherein the points of displacement $P_e$ of the actuators associated with segments $Z_e$ of the finishing metering device E are spaced unevenly so that they form two different sizes of divisions $T_{e1}$ and $T_{e2}$. Furthermore, every third point of displacement $P_e$ of actuators associated with segments $Z_e$ of the finishing metering device E is directly in line with a point of displacement $P_v$ of actuators associated with segments $Z_v$ of the pre-metering device V as seen along the direction of movement of material layer 4. Alternatively, different sizes of subdivisions can be formed by the locations of adjacent points of displacement $P_v$ of segments $Z_v$ of pre-metering device V being unevenly spaced along the width of moving layer of material 4. This results in a configuration where the number and location of the respective points of displacement of actuators associated with segments of the pre-metering and finishing metering would be switched with respect to FIG. 6.

Figure 7:
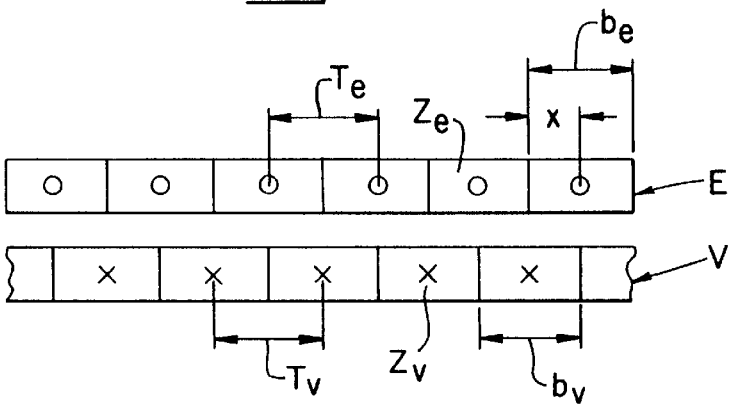

FIG. 7 shows a fifth embodiment analogous to that shown in FIG. 3. Segments $Z_v$ of pre-metering device V are shifted with respect to segments $Z_e$ of finishing metering device E along the width of moving layer of material 4 by a predetermined distance x. The amount of shift x is equal to one half of the widths $b_v$ and $b_e$ of the equally wide segments of pre-metering device V and finishing metering device E. Sub-divisions $T_V$ defined by the distance between points of displacement $P_V$ are not in line along the direction of movement of material layer 4 with sub-divisions $T_e$ defined by the distance between points of displacement $P_e$. The same holds true for the points of displacement of adjacent actuators associated with segments of pre-metering device V and finishing metering device E.

Figure 8:
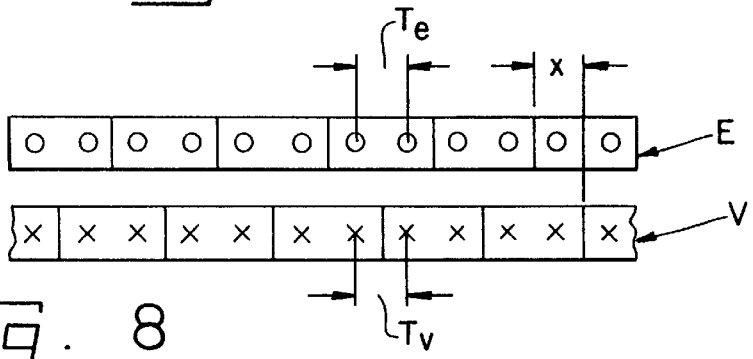

FIG. 8 shows the sixth embodiment of the apparatus described in this invention analogous to that shown in FIG. 3. The segments of the pre-metering device and the finishing metering device are shifted with respect to one another along the width of the moving layer of material as seen along the direction of its movement by a predetermined amount $x=0.5*b_v$, or $x=0.5*b_e$. Each of the segments is associated with the same number of actuators and thus also the same number of points of displacement whereby the sub-divisions $T_v$ and $T_e$ defined by the distance between points of displacement of adjacent actuators are equal for the pre-metering and the finishing metering devices. For this sort of configuration the points of displacement $P_V$ of adjacent actuators associated with the segments of pre-metering device V are in line along the direction of movement of the material layer with the points of displacement of adjacent actuators associated with the segments of finishing metering device E.

Figure 9:
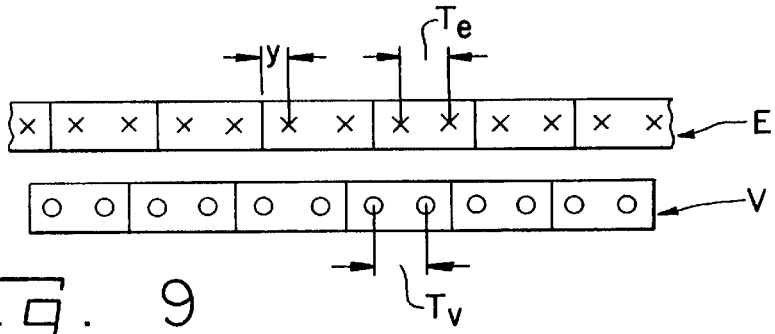

FIG. 9 shows a variation of FIG. 8 which is a seventh embodiment analogous to the one shown in FIG. 3, where the points of displacement of adjacent segments of pre-metering device V are shifted with respect to the points of displacement of adjacent segments of finishing metering device E along the width of the moving layer of material as seen along the direction of its movement by a predetermined amount y which corresponds to one half of the equal length of sub-divisions $T_v$ and $T_e$.

Figure 10:
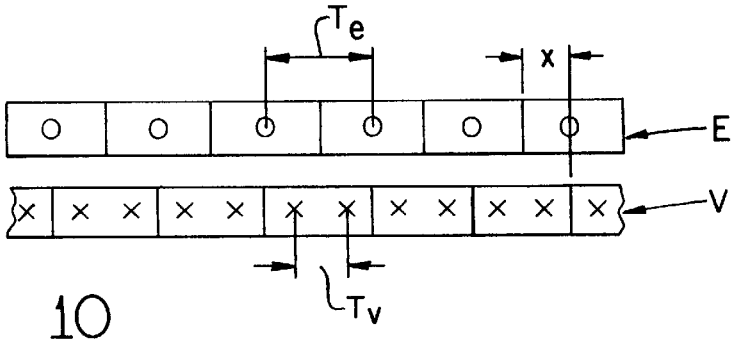

FIG. 10 shows an eighth embodiment of the apparatus of this invention wherein the segments of the pre-metering and the finishing metering device are shifted with respect to one another by a predetermined amount x and wherein the length of sub-division $T_e$ is an integer multiple of the length of sub-division $T_v$. The embodiment presented in FIG. 10, $T_e=T_v*2$. Looking along the path of movement of the material layer and referring to its width, the sum of the lengths $T_e$ of any integer number of segments of the finishing metering device E does not equal the sum of the lengths $T_v$ of any integer number of segments of the pre-metering device V, or, in other terms: $\Sigma T_v \neq \Sigma T_e$ for any integer numbers of segments.

Figure 11:
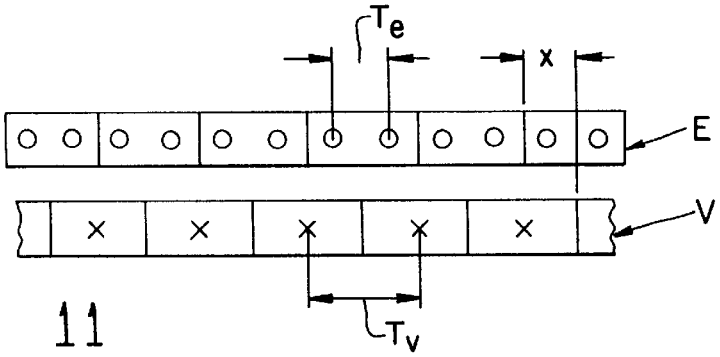

FIG. 11 shows a ninth embodiment of the applicator implement of this invention, which is a variation of the embodiment shown in FIG. 10 wherein the number and distribution of the points of displacement of the actuators associated with the segments of the pre-metering device and the finishing metering device have been exchanged.

Figure 12:
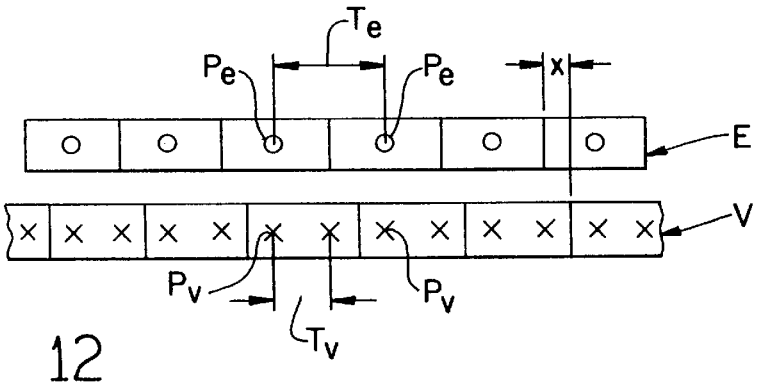

FIG. 12 shows a tenth embodiment of the apparatus of this invention which is another variation of the embodiment presented in FIG. 10. The displacement x along the direction of width of the moving layer of material of the segments of pre-metering device V with respect to the segments of finishing metering device E as well as the number and distribution of the points of displacement of the actuators associated with these segments is chosen such that with respect to the width of the moving layer of material seen along its direction of movement the sum of the smaller sub-divisions $T_v$ is equal to the sum of the greater sub-divisions $T_e$. Furthermore, the single point of displacement $P_e$ of one actuator associated with every segment of finishing metering device E is directly in line as seen along the direction of movement of the layer of material with the first of two points of displacement $P_v$ of two actuators associated with each segment of pre-metering device V.

Figure 13:
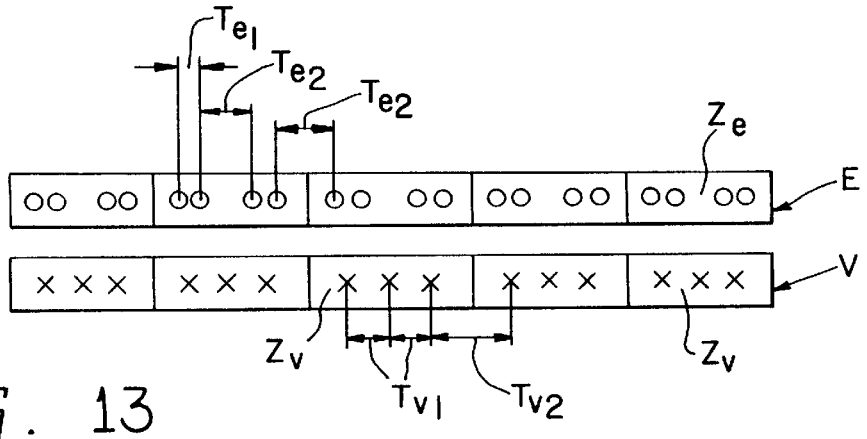

FIG. 13 shows the eleventh and final embodiment of the coating machine analogous to that shown in FIG. 3, wherein segments $Z_v$ and $Z_e$ are directly in line with one another as seen along the direction of movement of the layer of material. This variation features two different sub-divisions $T_{v1}$ and $T_{v2}$ for the pre-metering device as well as two different sub-divisions $T_{e1}$ and $T_{e2}$ for finishing metering device E. Sub-division $T_{v2}$ for the pre-metering device represents the distance between two adjacent actuators associated with two different adjacent segments, while sub-division $T_{v1}$ of pre-metering device V represents the equal distance between adjacent ones of three actuators associated with the same segment.

Figure 14:
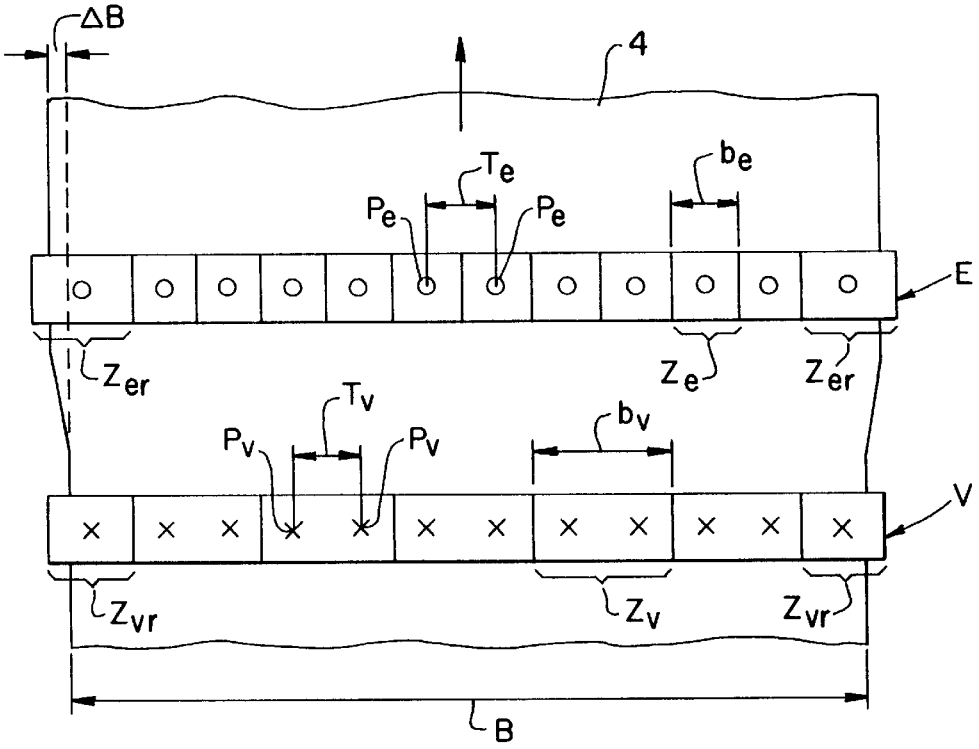
FIGS. 14–20 are each a schematic top view of separate embodiments of the segments of the pre-metering device and the finishing metering device of the second base model of FIG. 2, each of which is for illustration purposes shown on the same sketching plane.

FIG. 14 shows a top schematic view of a first embodiment of the second base model of the applicator implement of the present invention wherein segments $Z_V$ of pre-metering device V and segments $Z_E$ of finishing metering device E are for illustration purposes shown on the same sketching plane. Both segments $Z_v$ of pre-metering device V and segments $Z_e$ of finishing metering device E are represented by simplified rectangular boxes in this drawing. Segments $Z_v$ and $Z_e$ extend transverse to the direction of movement of layer of material 4, substantially covering the entire width B of the material layer. Width $b_v$ of the segments of pre-metering device V is different from Width $b_e$ of the segments of finishing metering device E. The width of segments $Z_v$ of the pre-metering device is twice that of segments $Z_e$ of the finishing metering device. As in FIG. 3, the different segments $Z_v$ and $Z_e$ of pre-metering device V and finishing metering device E, respectively, are directly in line as seen along the direction of movement of layer of material 4 without any transverse misalignment. The number of the respective segments $Z_v$ and $Z_e$ as well as their respective widths $b_v$ and $b_e$ may differ depending on the sort of application, so that the distribution and relative sizes seen in FIG. 14 have only illustrating value. According to FIG. 3, pre-metering device V as well as finishing metering device E include fringe segments $Z_{vr}$ and $Z_{er}$ which extend past moving layer of material 4. Width $b_{vr}$ of fringe segments $Z_{vr}$ is different from width $b_v$ of the other segments $Z_v$ of pre-metering device V. Also, width $b_{er}$ of fringe segments $Z_{er}$ is different from width $b_e$ of the other segments $Z_e$ of finishing metering device E. In addition, width $b_{vr}$ of fringe segments $Z_{vr}$ of pre-metering device V is different from width $b_{er}$ of fringe segments $Z_{er}$ of finishing metering device E in order to accommodate an increase in width $\Delta B$ of moving material layer 4 due to a sort of dilation that results from the application of the liquid or pasty coating medium. This effect can be observed as the material layer passes pre-metering device V.

There is no reason why the previously discussed fringe segments $Z_{vr}$ and $Z_{er}$ can not have the same widths as all the other segments $Z_v$ and $Z_e$ of pre-metering device V and finishing metering device E, respectively. This can be achieved if, for example, a fringe segment $Z_{vr}$ or $Z_{er}$ is either a regular segment $Z_v$ or a regular segment $Z_e$ of pre-metering device V or finishing metering device E, respectively.

Points of displacement $P_V$ where actuators $\mathbf{14}_V$ attach to pre-metering device V are generally represented as crosses while points of displacement $P_e$ where actuators $\mathbf{14}_e$ attach to finishing metering device E are represented as little circles. In the context of this invention, the term, "point of displacement of an actuator," should be understood as an infinitesimally small region where the actuator attaches to pre-metering device V or finishing metering device E.

In this embodiment, each segment $Z_v$ of pre-metering device V in the applicator implement is associated with two actuators while each segment $Z_e$ of finishing metering device E is associated with one actuator. Accordingly, there are two points of displacement $P_v$ for every segment $Z_v$ and one point of displacement $P_e$ for every segment $Z_e$. Sub-divisions $T_v$, which are defined by the spacing of the points of displacement $P_v$, are, as seen along the direction of movement of layer of material 4, in line with sub-divisions $T_e$, which are defined by the spacing of the points of displacement $P_e$. There can be situations that require a slight shift of the locations of the fringe segments $Z_{vr}$ relative to the fringe elements $Z_{er}$ along the width of moving layer of material 4 in order to accommodate a dilation by amount $\Delta B$ of the layer of material.

The following paragraphs explain FIGS. 15 through 20 which all depict the view shown in FIG. 14, whereby the moving layer of material is excluded from the view in order to prevent the diagram from becoming convoluted.

Figure 15:
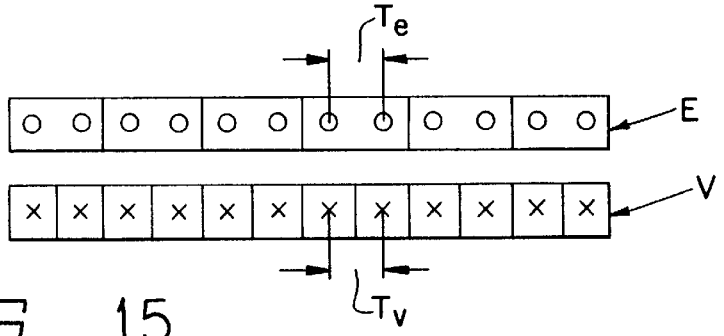

FIG. 15 depicts a variation of the embodiment shown in FIG. 14 corresponding to the second embodiment of the second base model of the applicator implement of this invention, wherein the number and distribution of the points of displacement of the pre-metering device have been exchanged with the number and distribution of the points of displacement of the finishing metering device as compared to the version shown in FIG. 14. This embodiment also has the width $b_e$ of the segments $Z_e$ of finishing metering device E larger than the segments $Z_v$ of pre-metering device V.

Figure 16:
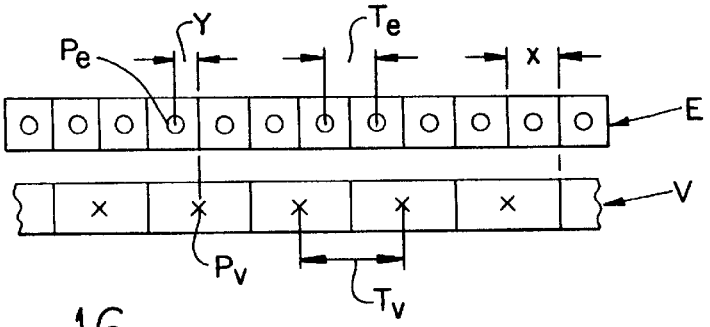

FIG. 16 shows a third embodiment of the second base model of the applicator implement of this invention, analogous to the embodiment shown in FIG. 14, wherein the segments $Z_v$ and $Z_e$, which have one point of deflection per segment in spite of having different widths, are located directly in line with one another along the direction of movement of the layer of material without any lateral displacement with respect to one another along the width of the moving layer of material. Sub-divisions $T_v$, which are defined by the spacing of points of displacement $P_v$, are, as seen along the direction of movement of layer of material 4, not in line with sub-divisions $T_e$, which are defined by the spacing of points of displacement $P_e$. The ratio of division $T_v$ over division $T_e$ is in this case an integer. In case of the example shown in this figure the following relation holds: $T_v=2*T_e$. By looking at the pre-metering device and the finishing metering device along the direction of movement of the layer of material, it becomes apparent that relative to the width of the material layer the sum of all the lesser divisions $T_e$ is not equal to the extension of the greater divisions $T_v$. Consequently the locations of points of deflection $P_v$ of pre-metering device V are not in line with the locations of points of deflection $P_e$ of finishing metering device E. Points of deflection $P_v$ of pre-metering device V are displaced by a distance Y along the width of the moving layer of material relative to the locations of points of deflection $P_e$ of finishing metering device E.

Figure 17:
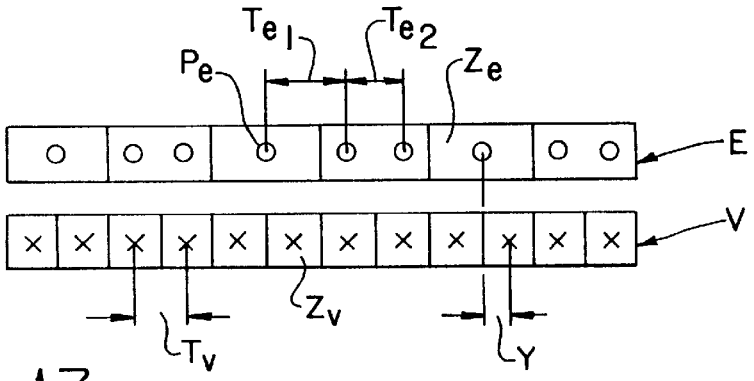

FIG. 17 shows a fourth embodiment of the second base model of the applicator implement of this invention, analogous to the embodiment shown in FIG. 14, wherein segments $Z_v$ and $Z_e$, which are of different widths, are located in line with one another as seen along the direction of movement of the layer of material. Two different sub-divisions, $T_{e1}$ and $T_{e2}$, are defined by the variable spacing of points of displacement $P_e$ of segments $Z_e$ of finishing metering device E. Some segments $Z_e$ of the finishing metering device are associated with one point of displacement $P_e$ while others are associated with two points of displacement. Consequently, some points of displacement $P_e$ are directly in line along the direction of movement of the material layer with points of displacement $P_v$. Other points of displacement $P_e$ are displaced along the width of the material layer with respect to points of displacement $P_v$ by a distance Y. Alternatively, points of displacement $P_v$ of segments $Z_v$ of pre-metering device V can be variably spaced, thus creating two different sub-divisions ($T_{v1}$ and $T_{v2}$).

Figure 18:
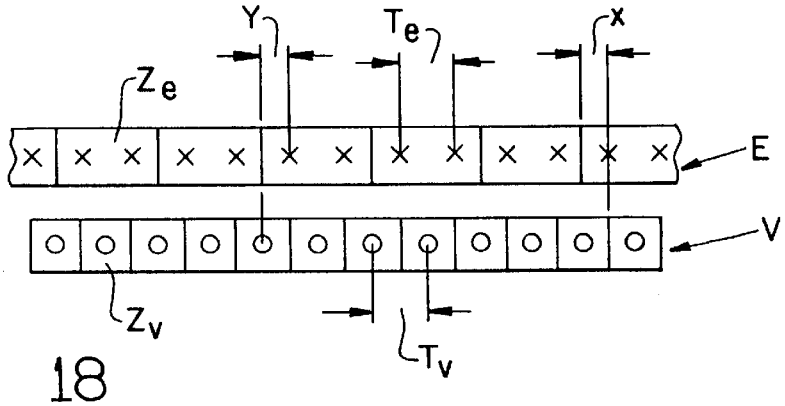

FIG. 18 shows a fifth embodiment of the second base model of the applicator implement of this invention, analogous to the embodiment shown in FIG. 14. Segments $Z_v$ of the pre-metering device and $Z_e$ of the finishing metering device are of different widths and are displaced by a predetermined distance x along the width of layer of material 4 as seen along the direction of movement of layer of material 4. Distance x is equal to one half of width $b_v$ of segment $Z_v$ of pre-metering device V, $b_v$ being less than width $b_e$ of segment $Z_e$ of finishing metering device E. The resulting sums along the respective widths of the pre-metering device and the finishing metering device of divisions $T_e$ and $T_v$ are not equal. Further, the locations of points of displacement $P_v$ of pre-metering device V and of points of displacement $P_e$ of finishing metering device E are not in line along the path of movement of the material layer, but are displaced by a distance Y along the width of the moving layer of material.

Figure 19:
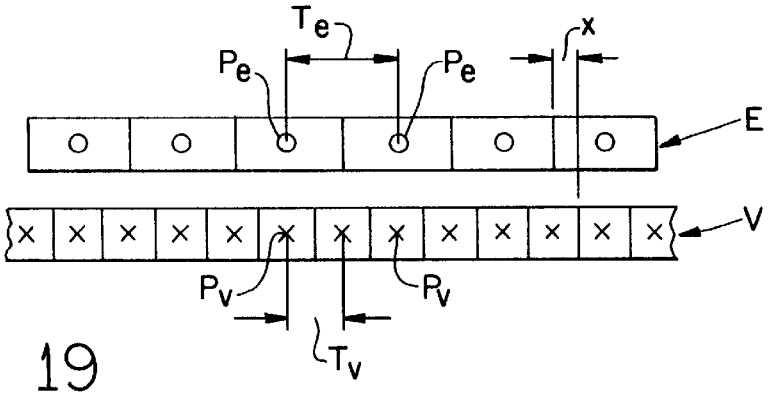

FIG. 19 shows a sixth embodiment of the second base model of the applicator implement of this invention, analogous to the embodiment shown in FIG. 14, and is, in essence, a variation of the embodiment shown in FIG. 18. One point of deflection is assigned to each segment of the pre-metering device and the finishing metering device. The segments of pre-metering device V are offset by a predetermined amount x with respect to segments of finishing metering device E. The widths and the placement of the points of displacement are chosen such that the sum of a number of divisions $T_v$, which are smaller than $T_e$, cover the same distance as one division $T_e$ along the width of the moving layer of material. A relation of the same distance covered of these two different divisions can be written as $T_e=2*T_v$. Looking along the path of movement of the layer of material, there is a point of displacement $P_e$ of finishing metering device E at every other point of displacement $P_v$ of pre-metering device V.

Figure 20:
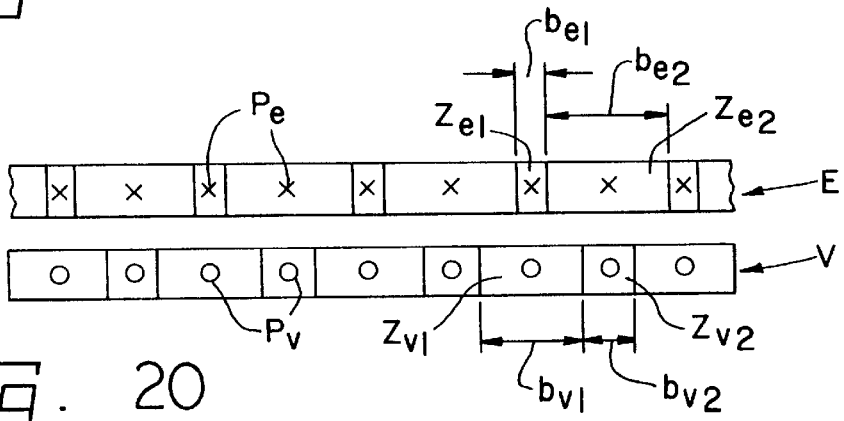

FIG. 20 shows the seventh and last embodiment of the second base model of the applicator implement of this invention, analogous to the embodiment shown in FIG. 14.

The section sizes of pre-metering device V are different from the section sizes of finishing metering device E. In addition, pre-metering device V has two different types of segments $Z_{v1}$ and $Z_{v2}$ with respective segment widths $b_{v1}$ and $b_{v2}$. Finishing metering device E also has at least two different types of segments $Z_{e1}$ and $Z_{e2}$ with different respective segment widths $b_{v1}$ and $b_{v2}$. The four different types of segments $Z_{v1}$, $Z_{v2}$, $Z_{e1}$ and $Z_{e2}$ of the pre-metering device and the finishing metering device are offset with respect to one another along the width of the layer of material as seen along its path of movement.

The widths of segments $b_{v1}$, $b_{v2}$, $b_{e1}$ and $b_{e2}$, as well as the number and placement of points of displacement $P_v$ and $P_e$ are chosen such that points of displacement $P_v$ and $P_e$ are directly in line with one another as seen along the direction of movement of the layer of material.

In order to control the desired cross-sectional thickness profile of a liquid or pasty coating medium which is applied directly by the applicator implement onto a moving layer of material 4, in particular paper or cardboard, one makes necessary adjustments by moving actuators $\mathbf{14}_v$ of pre-metering device V as a first correction and subsequent adjustments by the moving actuators of finishing metering device E as a second correction. Thus, the first and second corrections complement one another in a precise and effective manner.

To optimize the control over the cross-sectional thickness profile of the coating, long-wave and short-wave corrections to the coating thickness are utilized by coordinated adjustments of actuators $\mathbf{14}_v$ associated with pre-metering device V and finishing metering device E, respectively, to correct deviations from the nominal coating thickness. Analogous to this method, another method utilizes short-wave corrections with pre-metering device V and long-wave corrections with finishing metering device E to correct deviations from the nominal coating thickness. If actuators 14 associated with pre-metering device V are predominantly used to correct long-wave profile sections, then it is common to employ a lesser number of actuators $\mathbf{14}_v$ than the number of actuators $\mathbf{14}_e$. As mentioned earlier, actuators $\mathbf{14}_v$ and $\mathbf{14}_e$ of the pre-metering device and the finishing metering device, respectively, are both connected to a control loop (not shown). Adjustments to these actuators can be done in sequence or more or less simultaneously.

Figure 21:
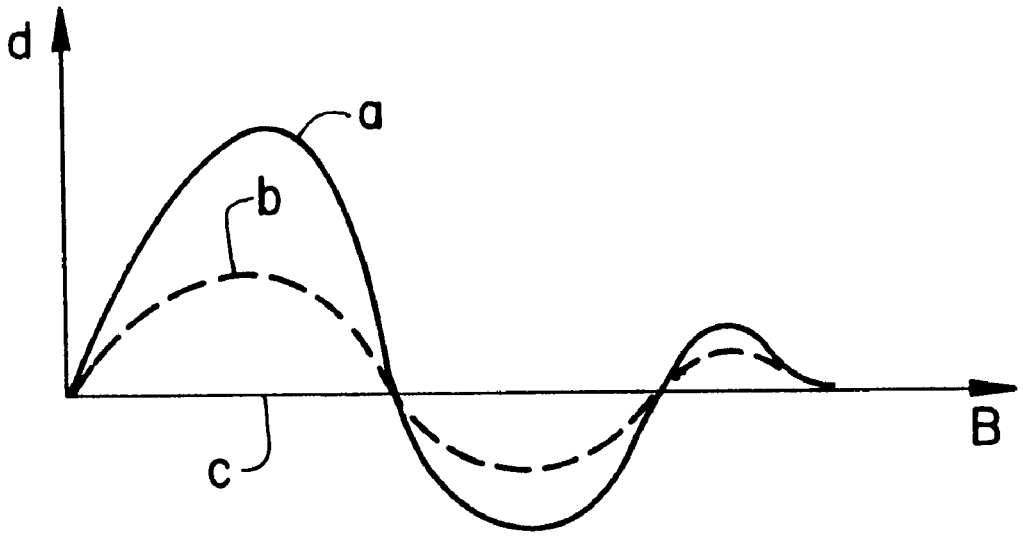
FIG. 21 is a graphical illustration of the deviations from the profile of the coating thickness along the direction of the width of the moving material layer for different process conditions provided by the first and second base model of the coating machine of the present invention.

Rough adjustments to the coating thickness profile can be made with pre-metering device V and subsequent fine adjustments to the coating thickness profile can be made with finishing metering device E. Alternatively, fine adjustments to the coating thickness profile can be made with pre-metering device V and subsequent rough adjustments to the coating thickness profile can be made with finishing metering device E. One is in this matter free to choose the order of the adjustments to the thickness profile. The effects of different sorts of adjustment are illustrated in FIG. 21 in a plot which monitors deviations d from a cross-sectional thickness across width B of the material layer for different process conditions and setups of the applicator implement, wherein:

Curve a) represents process conditions without any control over the thickness profile;

Curve b) represents process conditions with rough adjustments to the thickness profile with either the pre-metering device or the finishing metering device; and Curve c) represents process conditions with fine adjustments to the thickness profile with either the pre-metering device or the finishing metering device.

The invention is not limited to the before-mentioned examples of variations of different embodiments, which only serve to illustrate the possible variations. The scope of protection of the applicator implement of this invention encompasses more than the before-mentioned embodiments. An applicator implement can incorporate any combination of the before-mentioned features and variations. Furthermore, there are possibilities for configurations which conform to the basic concepts illustrated in the attached figures, whereby the number and distribution of the points of displacement of the pre-metering device are just exchanged with the number and distribution of the points of displacement of the finishing metering device, such as was illustrated in FIGS. 9 and 10. The above-mentioned size of subdivisions $T_v$ and $T_e$ can, of course, if so required, not be related to one another by integers. For these sorts of variation it is possible that one or more points of displacement of the finishing metering device are in line with one or more points of displacement of the pre-metering device as seen along the path of movement of the layer of material and/or that a sum of the lesser sub-divisions would be equal to the larger sub-division as seen along the path of movement of the layer of material.

The symbols employed in the specification or in the drawings simply serve as references to ease the understanding and shall not limit the scope of protection of the patent.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for applying a coating medium having a thickness profile onto a traveling fiber material web having a width extending along a latitudinal direction, said apparatus comprising:

at least one pre-metering device for applying and metering the coating medium onto the fiber material web, said pre-metering device including a plurality of segments disposed end-to-end relative to each other and extending substantially across the width of the fiber material web, each said segment having an equal width;

a plurality of first actuators, at least one said first actuator being associated with each said segment of said pre-metering device, each said first actuator being configured to move said associated segment of said pre-metering device and thereby adjust the thickness profile;

at least one finishing metering device for local adjustments to the thickness profile of the coating medium, said finishing metering device disposed at a location after said pre-metering device relative to a direction of travel of the fiber material web, said finishing metering device including a plurality of segments disposed end-to-end relative to each other and extending substantially across the width of the fiber material web, each said segment of said finishing metering device having an equal width which is identical to said equal width of said segments of said pre-metering device, each said segment of said finishing metering device being not aligned with a corresponding said segment of said pre-metering device in the direction of web travel such that each said segment of said finishing metering device is displaced by a predetermined distance with respect to a corresponding said segment of said pre-metering device in the latitudinal direction of the fiber material web; and a plurality of second actuators, at least one said second actuator being associated with each said segment of said finishing metering device, each said second actuator being configured to move said associated segment of said finishing metering device and thereby adjust the thickness profile.

2. The apparatus of claim 1, wherein said predetermined distance is equal to one half said identical equal width of one of said segments of said pre-metering device and of said finishing metering device.

3. The apparatus of claim 1, wherein said segments of said pre-metering device and of said finishing metering device have a plurality of points of displacement, one of said first actuators and said second actuators being attached to one said segment at each said point of displacement, said pre-metering device having a plurality of equal sub-divisions, each of said equal sub-divisions being defined by a distance separating an adjacent two said points of displacement of said pre-metering device, said finishing metering device having a plurality of equal sub-divisions, each of said equal sub-divisions being defined by a distance separating an adjacent two said points of displacement of said finishing metering device, said sub-divisions of said pre-metering device being identical to said sub-divisions of said finishing metering device.

4. The apparatus of claim 3, wherein each said point of displacement of said pre-metering device is aligned with a corresponding said point of displacement of said finishing metering device in the direction of web travel.

5. The apparatus of claim 3, wherein each said point of displacement of said pre-metering device is not aligned with a corresponding said point of displacement of said finishing metering device in the direction of web travel such that each said point of displacement of said pre-metering device is displaced by a predetermined distance with respect to a corresponding said point of displacement of said finishing metering device in the latitudinal direction of the fiber material web.

6. The apparatus of claim 5, wherein said predetermined distance displacing each said point of displacement of said pre-metering device is equal to one half said identical sub-divisions of said pre-metering device and said finishing metering device.

7. The apparatus of claim 3, wherein said sub-divisions of said pre-metering device are not identical to said sub-divisions of said finishing metering device.

8. The apparatus of claim 7, wherein one of said sub-divisions of said pre-metering device and said sub-divisions of said finishing metering device are integer multiples of the other of said sub-divisions of said pre-metering device and said sub-divisions of said finishing metering device.

9. The apparatus of claim 8, wherein said sub-divisions of said finishing metering device are integer multiples of said sub-divisions of said pre-metering device.

10. The apparatus of claim 7, wherein said sub-divisions of said pre-metering device are not integer multiples of said sub-divisions of said finishing metering device and said sub-divisions of said finishing metering device are not integer multiples of said sub-divisions of said pre-metering device.

11. The apparatus of claim 3, wherein said pre-metering device has a plurality of equal first sub-divisions and a plurality of equal second sub-divisions, said equal first sub-divisions being larger than said equal second sub-divisions, said equal first sub-divisions disposed in alternating succession with said equal second sub-divisions in the latitudinal direction of the fiber material web.

12. The apparatus of claim 3, wherein said finishing metering device has a plurality of equal first sub-divisions and a plurality of equal second sub-divisions, said equal first sub-divisions being larger than said equal second sub-divisions, said equal first sub-divisions disposed in alternating succession with said equal second sub-divisions in the latitudinal direction of the fiber material web.

13. The apparatus of claim 3, wherein each of said pre-metering device and said finishing metering device includes at least one fringe segment disposed end-to-end relative to an end one of said segments of one of said pre-metering device and said finishing metering device, each said fringe segment extending past the width of the fiber material web, each said fringe segment having one of said points of displacement, at least one said point of displacement of a selected said fringe segment of said pre-metering device being aligned with a corresponding said point of displacement of a selected said fringe segment of said finishing metering device in the direction of web travel.

14. An apparatus for applying a coating medium having a thickness profile onto a traveling fiber material web having a width extending along a latitudinal direction, said apparatus comprising:

at least one pre-metering device for applying and metering the coating medium onto the fiber material web, said pre-metering device including a plurality of segments disposed end-to-end relative to each other and extending substantially across the width of the fiber material web, each said segment having an equal width;

a plurality of first actuators, at least one said first actuator being associated with each said segment of said pre-metering device, each said first actuator being configured to move said associated segment of said pre-metering device and thereby adjust the thickness profile;

at least one finishing metering device for local adjustments to the thickness profile of the coating medium, said finishing metering device disposed at a location after said pre-metering device relative to a direction of travel of the fiber material web, said finishing metering device including a plurality of segments disposed end-to-end relative to each other and extending substantially across the width of the fiber material web, each said segment of said finishing metering device having an equal width which is identical to said equal width of said segments of said pre-metering device; and a plurality of second actuators, at least one said second actuator being associated with each said segment of said finishing metering device, each said second actuator being configured to move said associated segment of said finishing metering device and thereby adjust the thickness profile;

wherein at least one of said pre-metering device and said finishing metering device includes at least one fringe segment disposed end-to-end relative to an end one of said segments of one of said pre-metering device and said finishing metering device, each said fringe segment extending past the width of the fiber material web.

15. The apparatus of claim 14, wherein said at least one fringe segment has a width not equal to said equal width of other said segments.

16. An apparatus for applying a coating medium having a thickness profile onto a traveling fiber material web having a width extending along a latitudinal direction, said apparatus comprising:

at least one pre-metering device for applying and metering the coating medium onto the fiber material web, said pre-metering device including a plurality of segments disposed end-to-end relative to each other and extending substantially across the width of the fiber material web, each said segment having a width, each said width being variable;

a plurality of first actuators, at least one said first actuator being associated with each said segment of said pre-metering device, each said first actuator being configured to move said associated segment of said pre-metering device and thereby adjust the thickness profile;

at least one finishing metering device for local adjustments to the thickness profile of the coating medium, said finishing metering device disposed at a location after said pre-metering device relative to a direction of travel of the fiber material web, said finishing metering device including a plurality of segments disposed end-to-end relative to each other and extending substantially across the width of the fiber material web, each said segment of said finishing metering device having a width, each said width of each said segment of said finishing metering device being variable, each said width of each said segment of said finishing metering device being different from said equal width of each said segment of said pre-metering device; and a plurality of second actuators, at least one said second actuator being associated with each said segment of said finishing metering device, each said second actuator being configured to move said associated segment of said finishing metering device and thereby adjust the thickness profile.

17. The apparatus of claim 16, wherein each said segment of said pre-metering device is displaced by a predetermined distance with respect to a corresponding said segment of said finishing metering device in the latitudinal direction of the fiber material web, said predetermined distance being equal to one half a lesser of said width of one of said segments of said pre-metering device and said width of one of said segments of said finishing metering device.

18. A method of controlling the thickness profile of a coating medium on a traveling fiber material web having a width extending along a latitudinal direction, said method comprising the steps of:

providing at least one pre-metering device each segment of the said finish metering device having a width, each said width of each said segment of said finish metering device being variable including a plurality of segments disposed end-to-end relative to each other and extending substantially across the width of the fiber material web, each said second adjustment results from moving a respective one of said segments of said finishing metering device using a respective one of said second actuators;

attaching at least one first actuator to each said segment of said pre-metering device;

providing at least one finishing metering device at a location after said pre-metering device relative to a direction of travel of the fiber material web, said finishing metering device including a plurality of segments disposed end-to-end relative to each other and extending substantially across the width of the fiber material web each segment of the said pre-metering device having a width, each said width of each segment of said pre-metering being variable;

attaching at least one second actuator to each said segment of said finishing metering device; and adjusting the thickness profile by moving said segments of said pre-metering device with said first actuators and by moving said segments of said finishing metering device with said second actuators, said moving step including the steps of:

making first adjustments to the thickness profile with said pre-metering device for applying and metering the coating medium onto the fiber material web; said at least one pre-metering device; and making second adjustments to the thickness profile with said finishing metering device, each said first adjustment results from moving a respective one of said segments of said premetering device using a respective one of said first actuators each of said second adjustments being smaller in width than each of said first adjustments.

19. A method of controlling the thickness profile of a coating medium on a traveling fiber material web having a width extending along a latitudinal direction, said method comprising the steps of:

providing at least one pre-metering device each segment of the said finish metering device having a width, each said width of each said segment of said finish metering device being variable including a plurality of segments disposed end-to-end relative to each other and extending substantially across the width of the fiber material web, each said second adjustment results from moving a respective one of said segments of said finishing metering device using a respective one of said second actuators;

attaching at least one first actuator to each said segment of said pre-metering device;

providing at least one finishing metering device at a location after said pre-metering device relative to a direction of travel of the fiber material web, said finishing metering device including a plurality of segments disposed end-to-end relative to each other and extending substantially across the width of the fiber material web each segment of the said pre-metering device having a width, each said width of each segment of said pre-metering being variable;

attaching at least one second actuator to each said segment of said finishing metering device; and adjusting the thickness profile by moving said segments of said pre-metering device with said first actuators and by moving said segments of said finishing metering device with said second actuators, said moving step including the steps of:

making first adjustments to the thickness profile with said pre-metering device for applying and metering the coating medium onto the fiber material web; said at least one pre-metering device; and making second adjustments to the thickness profile with said finishing metering device, each said first adjustment results from moving a respective one of said segments of said premetering device using a respective one of said first actuators each of said second adjustments being larger in width than each of said first adjustments.

* * * * *

UNITED STATES PATENT AND TRADEMARK OFFICE

CERTIFICATE OF CORRECTION

PATENT NO. : 6,022,591
DATED : February 8, 2000
INVENTOR(S) : Manfred Ueberschar It is certified that error appears in the above-identified patent and that said Letters Patent is hereby corrected as shown below:

COLUMN 19

Line 50, claim 18, delete "each segment of the said finish metering device having a width, each said width of each said segment of said finish metering device being variable" and substitute -- for applying and metering the coating medium onto the fiber material web; said at least one pre-metering device-- therefor; and line 56, claim 18, delete "said second adjustment results from moving a respective one of said segments of said finishing metering device using a respective one of said second actuators" and substitute -- segment of said pre-metering device having a width, each said width of each segment of said pre-metering being variable-- therefor.

Column 20

Line 13, claim 18, delete "for applying and metering the coating medium onto the fiber material web; said at least one pre-metering device" and substitute --each said first adjustment results from moving a respective one of said pre-metering device using a respective one of said first actuators-- therefor;

line 17, claim 18, delete "first adjustment results from moving a respective one of said segments of said pre-metering device using a respective one of said first actuators" and substitute --second adjustment results from moving a respective one of said segments of said finishing metering device using a respective one of said actuators,-- therefor;

UNITED STATES PATENT AND TRADEMARK OFFICE

CERTIFICATE OF CORRECTION

PATENT NO. : 6,022,591

DATED : February 8, 2000

INVENTOR(S) : Manfred Ueberschar

It is certified that error appears in the above-identified patent and that said Letters Patent is hereby corrected as shown below:

line 27, claim 19, delete "each segment of the said finish metering device having a width, each said width of each said segment of said finish metering device being variable" and substitute --for applying and metering the coating medium onto the fiber material web; said at least one pre-metering device-- therefor;

line 33, claim 19, delete "said second adjustment results from moving a respective one of said segments of said finishing metering device using a respective one of said second actuators" and substitute --segment of said pre-metering device having a width, each said width of each segment of said pre-metering being variable-- therefor;

line 56, claim 19, delete "for applying and metering the coating medium onto the fiber material web; said at least one pre-metering device" and substitute --each said first adjustment results from moving a respective one of said pre-metering device using a respective one of said first actuators-- therefor; and

UNITED STATES PATENT AND TRADEMARK OFFICE

CERTIFICATE OF CORRECTION

PATENT NO. : 6,022,591

DATED : February 8, 2000

INVENTOR(S) : Manfred Ueberschar

It is certified that error appears in the above-identified patent and that said Letters Patent is hereby corrected as shown below:

line 60, claim 19, delete "first adjustment results from moving a respective one of said segments of said pre-metering device using a respective one of said first actuators" and substitute --second adjustment results from moving a respective one of said segments of said finishing metering device using a respective one of said actuators,-- therefor.

Signed and Sealed this

Thirteenth Day of February, 2001

Nicholas P. Godici

*Attest:*

NICHOLAS P. GODICI

*Attesting Officer*

*Acting Director of the United States Patent and Trademark Office*